United States Patent [19]

Saunders

[11] Patent Number: 4,553,475

[45] Date of Patent: Nov. 19, 1985

[54] LABORATORY HOOD ATTACHMENT

[75] Inventor: G. Thomas Saunders, Geneva, Ill.

[73] Assignee: St. Charles Manufacturing Co., St. Charles, Ill.

[21] Appl. No.: 487,162

[22] Filed: Apr. 21, 1983

[51] Int. Cl.[4] ..... F24F 11/00

[52] U.S. Cl. ..... 98/36; 98/115.3

[58] Field of Search ..... 98/36, 115 LH, 39; 62/296; 181/265, 270

[56] References Cited

U.S. PATENT DOCUMENTS 3,211,177 10/1965 Philips et al. ..... 98/38 B X
3,229,609 1/1966 Larson et al. ..... 98/36
3,362,469 1/1968 Berner et al. ..... 98/36 X
3,748,997 7/1973 Dean, Jr. et al. ..... 62/296 X
3,752,056 8/1973 Chamberlin et al. ..... 98/115 LH

*Primary Examiner*—William E. Wayner
*Attorney, Agent, or Firm*—Robert E. Wagner; Ralph R. Rath

[57] ABSTRACT

An attachment for a laboratory hood having an opening leading to a work area includes a housing that has a lower open end and opening means extending the entire length along an upper portion of the housing with fans located in the housing between the opening means and the lower open end. The attachment also has baffle means for diverting the air flow through the housing and diffuser means to distribute the air equally along the entire length of the unit.

9 Claims, 5 Drawing Figures

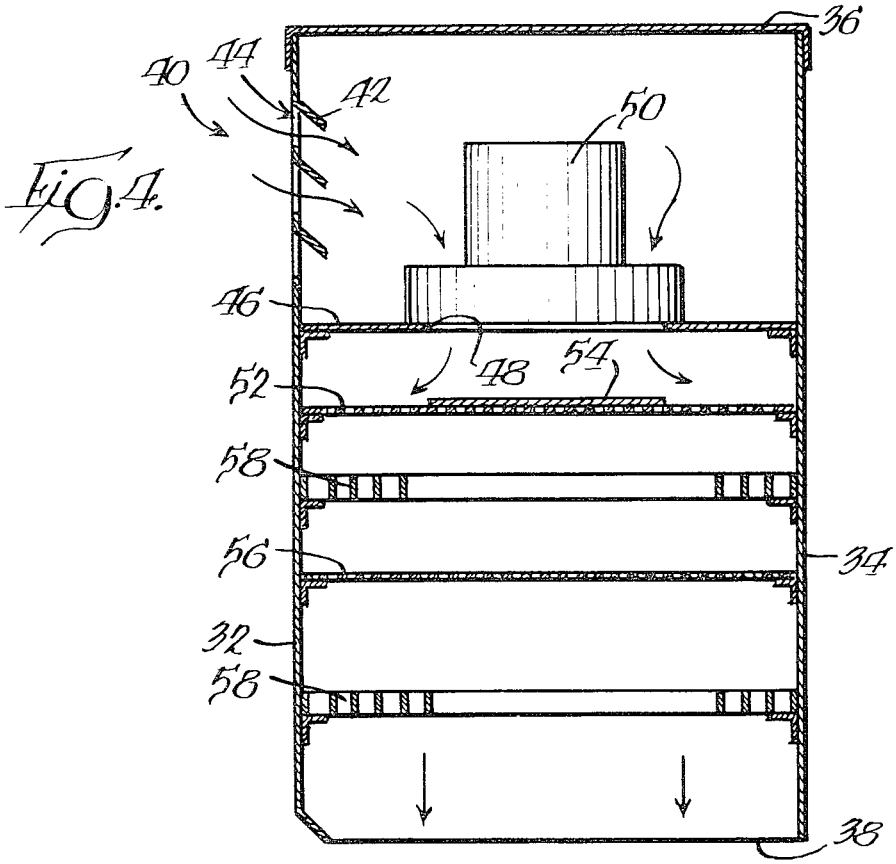
Fig. 4.
Fig. 5.
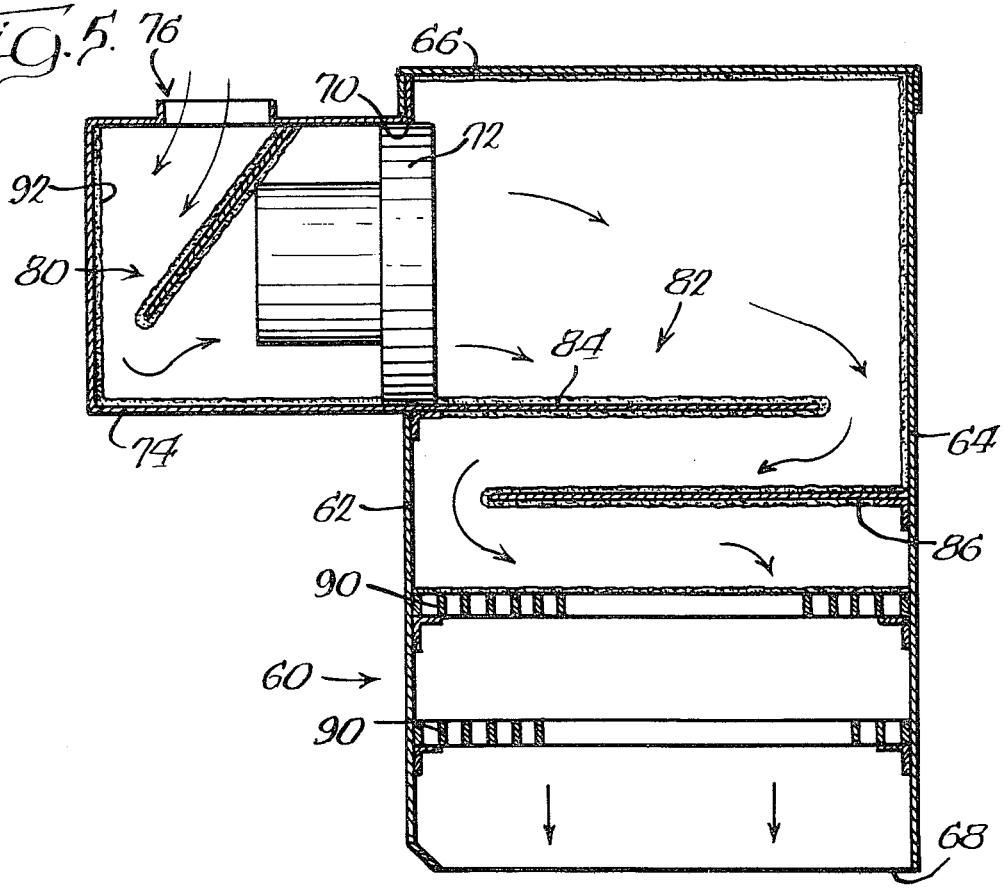

LABORATORY HOOD ATTACHMENT

DESCRIPTION

1. Technical Field

The present invention relates generally to laboratory hoods of the type having a work area located within a chamber and an opening leading from the front surface to gain access to the work area and, more particularly, to an attachment for providing an air curtain across the opening.

2. Background Prior Art

Laboratory hoods are conventionally employed in laboratories to remove hazardous odors and noxious fumes. For many years, various type of hoods had been used for the purpose of drawing off undesirable gases or other substances. Originally, fume hoods consisted of a working chamber having an open front and means in the form of a suction fan above the open chamber for drawing air through the opening to carry any undesirable gases or other substances from the chamber.

Many of the original hoods also incorporated some type of transparent shield that could be utilized to enclose the opening while the laboratory test was being conducted. For a long time, it was deemed necessary to have a minimum face air velocity on the order of about 100 feet per minute or greater, which results in withdrawing of a considerable amount of air from the room in which the hood is located. With the advent of air conditioning in most facilities, withdrawing such large amounts of air-conditioned air from the room is extremely costly.

With the provision of greater numbers and increased sizes of laboratory hoods, a marked increase in laboratory air change has resulted and has posed additional costs for both heating and air conditioning. To alleviate some of these problems, it has previously been proposed to utilize supplemental air from the atmosphere surrounding the building to provide a curtain of air across the open area of the laboratory hood so that most of the air that is drawn through the hood was outside, unconditioned air. Actual tests have shown that utilizing such a system allows for the reduction of the face velocity to about 60 feet per minute, thereby substantially decreasing the amount of power requirements for producing the necessary ventilation within the laboratory hood. However, such apparatus is extremely expensive to install and is also very time-consuming and results in a permanent installation. Therefore, without the installation of an extremely expensive auxillary system, the existing laboratory hoods must, of necessity, be operated at a flow rate in the range of 100 feet per minute face velocity. In many existing installations, it may be impossible to gain access to atmospheric air for installation of an auxillary system to an existing installed laboratory hood.

SUMMARY OF THE INVENTION

According to the present invention, a simple attachment has been developed which can be attached to existing laboratory hoods above the access opening and allows for the reduction of the required air flow through the opening by as much as 40%. The mechanism can be attached to an existing unit with no modification thereof and is totally self-contained, relying upon room air as the source of ventilation.

More specifically, the attachment of the present invention consists of an elongated, generally rectangular housing that has a length which is approximately equal to the width of the access opening to a work area in a laboratory hood. The housing is preferably rectangular in cross-section and has a front wall, a top wall, a rear wall and an open bottom end. Fan means are provided within the housing and an elongated opening is provided in the front wall so that room air can be drawn through the elongated opening by the fan means. The attachment also includes baffle means for diverting the air, as well as diffuser means for diffusing the air so that a substantially uniform flow of air flows through the lower open end of the housing and across the access area for the laboratory hood.

In one form of the invention, the fan means is in the form of a plurality of spaced fans that are supported on a divider wall within the housing and the openings are slits defined in the front wall of the housing above the divider, while the baffle and diffuser means are located between the fans and the lower open end of the housing.

In a modified preferred form of the invention, the fan means are in the form of a plurality of horizontally-spaced fans mounted in the front wall of the housing with an extension extending away from the front wall and enclosing the fans. The openings are again in the form of slits that are preferably formed in the top wall of the extension. In the preferred form of the invention, a first baffle is located between the opening leading to the interior of a room and the fan means, while a second baffle means is located within the housing. Preferably the second baffle means is in the form of two baffles, the first extending from the front wall and terminating short of the rear wall and a second baffle secured to the rear wall and terminating short of the front wall. The surfaces of the baffles, as well as the surfaces of the walls and extensions preferably have a soundproof coating thereon to reduce the noise level of the attachment.

BRIEF DESCRIPTION OF SEVERAL VIEWS OF DRAWINGS

FIG. 1 of the drawings discloses a laboratory hood having the attachment of the present invention supported thereon;

FIG. 4 is a cross-sectional view of the attachment; and,

FIG. 5 is a view similar to FIG. 4 showing a modified form of the invention.

DETAILED DESCRIPTION

Figure 1:
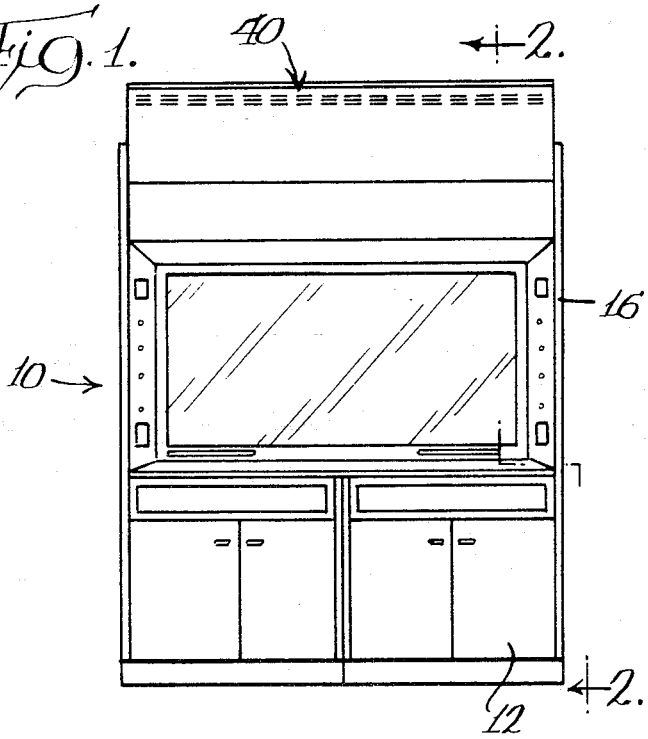

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
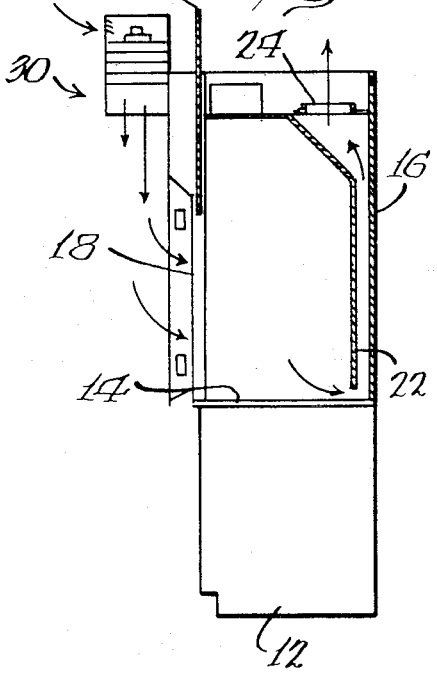
FIG. 2 is a side view of the laboratory hood as viewed along lines 2—2 of FIG. 1.
Figure 3:
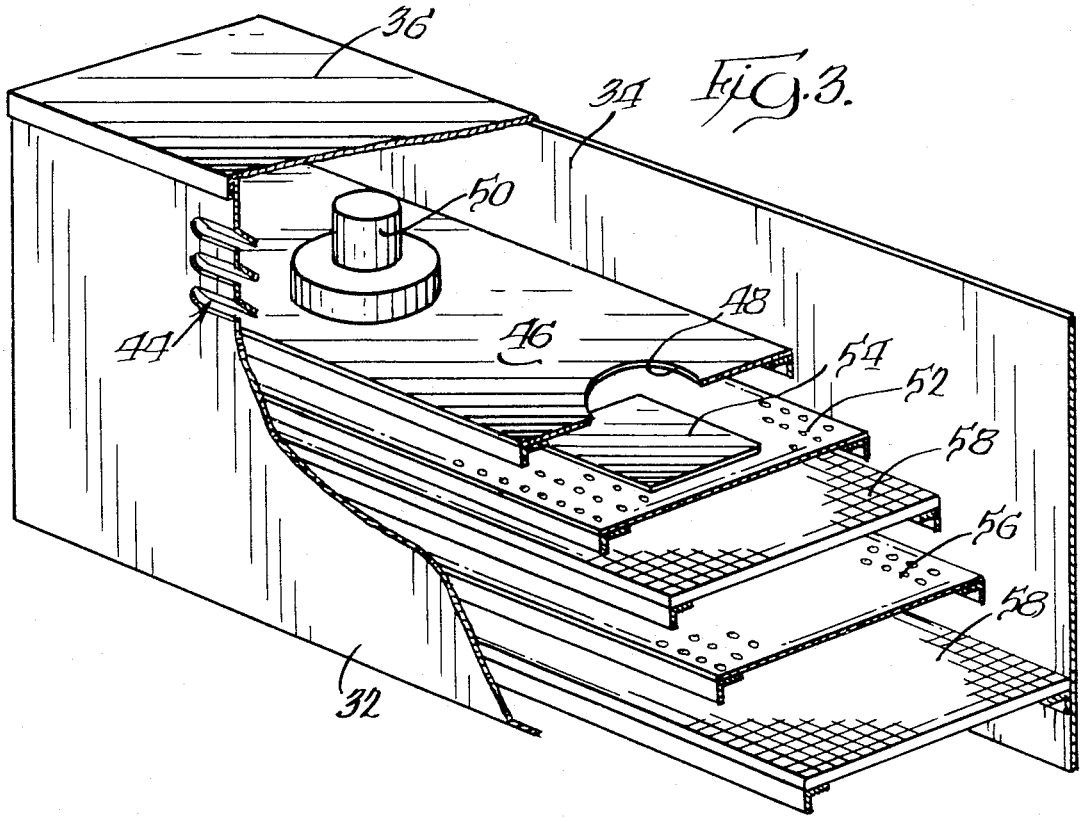
FIG. 3 is a prespective view of the attachment with parts thereof broken away for purposes of clarity.

FIG. 1 of the drawings discloses a laboratory fume hood, generally designated by reference numeral 10. The fume hood 10 consists of a base 12 that has a work area or surface 14. The work area 14 is enclosed by a super structure, generally designated by reference numeral 16, which has an opening 18 for gaining access to the work area. The access opening 18 may be sealed off by a suitable shield or cover 20. The conventional hood structure manufactured by the Assignee of the present invention incorporates a baffle structure 22 adjacent the rear wall which defines a flow path for air that is drawn in through the opening 18, as indicated by the arrows in FIG. 2. The air flow is produced by a suction fan (not shown) attached to outlet opening 24.

According to the present invention, a simple attachment has been developed which can reduce the air flow requirements for a laboratory or fume hood of the type described above by as much as 40%. The attachment or diffuser is generally desigated by reference numeral 30 and consists of a housing having a front wall 32, a rear wall 34, a top wall 36 and an open bottom 38. The front wall 32 has opening means 40 adjacent the upper edge thereof extending substantially the entire length of the front wall. The opening means 40 are defined by a plurality of tabs 42 cut from the front wall and bent inwardly to define a plurality of elongated openings 44.

The internal area of the housing has a divider wall 46 extending between the front and rear walls and divider wall 46 has a plurality of openings 48 therein. The divider wall supports a plurality of fans 50, preferably there are several such fans distributed equally along the length of the housing to provide a uniform and distributed flow of air, as will be described later.

The internal housing also has diffuser means between the fan means 50 and the lower open end 38. In the embodiment illustrated in FIG. 4, the diffuser means consists of an apertured plate 52 that extends between the front and rear walls 32 and 34 which supports a plurality of baffles 54 that are respectively aligned with the outlets of the respective fans 50. The baffles 54 will divert the incoming air towards the front and rear walls of the housing. A further apertured baffle plate 56 also extends between the front and rear walls and a pair of substantially identical rectangular grid structures 58 also form part of the diffuser means in the embodiment illustrated in FIG. 4. The apertured plates 52 and 56, as well as the rectangular open grid structure 58, collectively define the diffuser means between the fan means 50 and the lower open end 38 of the housing 30. The diffuser means aid in reducing the noise level for the unit, which can further be reduced by utilizing a sound-deadening coating on the entire surface of the walls of the housing.

With the unit so far described, actual tests have shown that attachment of a unit of this type to a conventional laboratory or fume hood 10 will produce an air curtain across the open area 18, which substantially reduces the effect of any exterior activity around the open area, such as a person walking across the open area, while the unit is in operation. It has been determined that the flow requirements for an existing fume hood 10 can be reduced by as much as 40% by utilizing the attachment 30 to provide an air curtain across the open area without any threat to the operator of inhaling any toxic fumes that may be produced within the working area of the hood. Actual tests have shown that the face velocity can be decreased from more than 100 feet per minute to approximately 60 feet per minute and still have the same ventilating properties as a fume hood without the diffuser attachment 30.

A slightly modified form of the invention is disclosed in FIG. 5 and again consists of a housing 60 that is generally rectangular in cross-section and extends the entire width of the fume hood 10. Housing 60 consists of a front wall 62, a rear wall 64, a top wall 66 and a bottom open end 68. In the embodiment illustrated in FIG. 5, the upper edge of the front wall has a plurality of horizontally-spaced openings 70 in which axial fans 70 are supported. The front wall 62 has a forwardly-extending, generally rectangular extension 74 that extends the entire length of the front wall and encloses the respective fans 72. Extension 74 has opening means 76 in the upper wall thereof to define an inlet for air entering from the room in which the fume hood 10 is located.

The attachment or air diffuser 60 also incorporates first baffle means 80 located between opening means 76 and fans 72 and second baffle means 82 located within the housing 60 between the fans 72 and the outlet opening 68. The first baffle means 80 preferably is in the form of an inclined plate that extends between openings 76 and fans 72. The second baffle means 82 consists of a first baffle plate 84 that is attached to the front wall 62 adjacent or directly below the fans 72 and the rear edge of the plate 84 is spaced from the rear wall. A second baffle plate 86 is secured to the rear wall and terminates short of the front wall, as shown in FIG. 5. Thus, the baffles cooperate to define a tortious path through the extension 74 and the housing 60.

The air diffuser 60, illustrated in FIG. 5, preferably also has one or more diffuser plates 90 located between baffle means 82 and the lower open end 68. The diffusers 90 may either be the rectangular open-grid structures or apertured plates, as desired. Preferably, the entire inner surface of the air diffuser 60 has a sound-proof coating 92 thereon.

The operation of the air diffuser 60, illustrated in FIG. 5, is again designed to substantially reduce the air flow requirements through the fume hood to which it is attached. By providing the baffles 80 and 82 to define a tortious path for the air flow, the sound of the unit is substantially reduced. This is further reduced by the sound-deadening coating 92 on the surfaces of the baffles, along with the inner surface of the housing.

As can be appreciated from the above description, the present invention can easily be attached to an existing fume hood and increase the overall efficiency of the fume hood, as well as decreasing the operational costs by a substantial degree. This is accomplished without the necessity of having complicated piping leading to an external atmosphere source which was heretofore believed necessary for increasing the efficiency of such a unit.

I claim:

1. An attachment for a laboratory hood having an opening lead to a work area comprising an elongated housing having front, rear and top walls, and a lower open end with said rear wall attached to said hood above said opening, opening means extending across said front wall adjacent an upper edge thereof, support means in said housing between said opening means and said lower open end of said housing, a plurality of fans supported in spaced relation on said support means, baffle means between said support means and said lower open end for diverting flow toward said front and rear walls so that air can be drawn through said opening means by said fan means and exhausted through said lower open end and provide a fluid barrier across said opening.

2. An attachment as defined in claim 1, further including sound-deadening diffuser means between said fan means and said lower open end.

3. An attachment as defined in claim 1 in which said fan means are mounted on said front wall, further including an extension extending away from said front wall with said opening means in said extension.

4. An attachment as defined in claim 3, further including first baffle means in said extension and additional baffle means in said housing providing tortious paths for air flow through said attachment.

5. In combination with a laboratory hood having a work area therein and an open area for gaining access to said work area, an attachment for providing an air curtain across said open area secured to said laboratory hood above said open area, said attachment including a generally rectangular elongated housing, having a top wall, a front wall, a rear wall and an open bottom; elongated opening means in said housing adapted for receiving room air; fan means in said housing between said opening means and said open bottom; a divider wall between said top wall and said open bottom, said divider wall having a plurality of openings with said fan means including a plurality of fans respectively mounted in said openings, and diffuser means between said fan means and said open bottom so that said fan means draws room air through said opening means and delivers an air curtain through said open bottom and across said open area.

6. The combination as defined in claim 5, further including a plurality of baffles supported below and spaced from said fans to divert air flow through said fans.

7. The combination as defined in claim 5 in which said fan means includes a plurality of horizontally-spaced fans mounted in said front wall, an extension extending from said front wall and enclosing said fans with said elongated opening means defined in said extension.

8. The combination as defined in claim 7, further including first baffle means between said elongated opening means and said fans, second baffle means in said housing and diffuser means between said second baffle means and said open bottom.

9. In combination with a laboratory hood having a work area therein and an open area for gaining access to said work area; an attachment attachable to said hood above said open area, said attachment including an elongated rectangular housing having a length substantially equal to the width of said open area and a bottom opening; fan means mounted in a front wall of said housing; extension means extending from said front wall and enclosing said fan means; opening means in said extension means; first baffle means in said extension means between said opening means and said fan means; second baffle means in said housing providing a tortious path for air flow through said housing; and diffuser means between said second baffle means and said bottom opening.

* * * * *